United States Patent [19]

Donivan et al.

[11] Patent Number: 5,047,802

[45] Date of Patent: Sep. 10, 1991

[54] PROCESS CONTROL OF ELECTROSTATOGRAPHIC MACHINE BY ADJUSTING CHARGE-TO-MASS RATIO OF TONER IN RESPONSE TO TONED DENSITY OF DEVELOPED IMAGE

[75] Inventors: Lawrence J. Donivan; Joseph F. Laukaitis, both of Rochester, N.Y.

[73] Assignee: Eastman Kodak Company, Rochester, N.Y.

[21] Appl. No.: 366,948

[22] Filed: Jun. 15, 1989

[51] Int. Cl.[5] ..... G03G 21/00; G03G 15/08

[52] U.S. Cl. ..... 355/208; 355/246

[58] Field of Search ..... 355/208, 214, 221, 226, 355/246

[56] References Cited

U.S. PATENT DOCUMENTS

| | | | |
|---|---|---|---|
| 4,026,643 | 5/1977 | Bergman | 355/246 |
| 4,647,184 | 3/1987 | Russell et al. | 355/208 |
| 4,745,282 | 5/1988 | Tagawa et al. | 355/221 X |
| 4,786,924 | 11/1988 | Folkins | 355/208 |
| 4,796,064 | 1/1989 | Torrey | 355/208 |

FOREIGN PATENT DOCUMENTS 59-164563 9/1984 Japan .

*Primary Examiner*—Fred L. Braun

*Attorney, Agent, or Firm*—Milton S. Sales

[57] ABSTRACT

Control over the electrostatographic process is provided by adjusting the toner charge-to-mass ratio in response to changes in toner contrast. An electrostatographic reproduction machine produces a signal having a value characteristic of the toned density of the developed image. Using the signal, the charge-to-mass ratio of the toner is adjusted. In a preferred embodiment, the signal is produced by comparing the toned density of the developed image to a reference value, and charge-to-mass is adjusted by directing an ion cloud over the toner particles.

12 Claims, 3 Drawing Sheets

PROCESS CONTROL OF ELECTROSTATOGRAPHIC MACHINE BY ADJUSTING CHARGE-TO-MASS RATIO OF TONER IN RESPONSE TO TONED DENSITY OF DEVELOPED IMAGE

BACKGROUND OF THE INVENTION

1. Technical Field

This invention relates generally to electrostatographic copying and/or printing machines, and more particularly to the maintenance of high image quality in the presence of changes in the ratio of toner particle electrostatic charge to toner particle mass (the charge-to-mass ratio).

2. Background Art

In electrostatographic machines such as printers and copiers, image contrast, density, and color balance can be adjusted by changing certain process control parameters, including toner concentration of the development mixture, primary voltage "$V_0$", bias voltage transfer voltage, and exposure. " For a detailed explanation of the theory of copier contrast and exposure control by controlling various process control parameters, reference may be made to the following article: Paxton, Electrophotographic Systems Solid Area Response Model, 22 Photographic Science and Engineering 150 (May/June 1978).

Generally in process control, a test patch or patches are imaged and developed on non-image areas of the transfer member. By feedback processes, abnormal toner density readings of the patches result in adjustments to at least one of the process control parameters to thereby return the density readings toward normal values.

Developed density is also a function of the ratio of the charge-to-mass ratio of the toner). As the charge-to-mass ratio increases, developed toner density decreases for a given potential difference in the development zone.

DISCLOSURE OF INVENTION

It is an object of the present invention to provide control over the electrostatographic process by adjusting the toner charge-to-mass ratio in response to changes in "toner contrast," as that term is defined below.

In accordance with one aspect of the present invention, an electrostatographic reproduction machine includes means for developing an electrostatic latent image with charged toner particles. A signal is produced having a value characteristic of the toned density of the developed image. Means responsive to said signal are provided for adjusting the charge-to-mass ratio of the toner. In a preferred embodiment, the signal producing means comprises means for comparing the toned density of the developed image to a reference value, and the adjusting means comprises a source of ions and means for directing the ions to the developer mixture. The source of ions is capable of producing positive and negative ions, and is preferably a corona charger.

In accordance with another aspect of the present invention, an electrostatographic reproduction machine includes means for developing an electrostatic latent image with charged toner particles, the developing means including a development station with a bias electrode. A toning contrast signal having a value characteristic of the ratio of the density of a developed image to the absolute value of the difference between the development station electrode bias and the charge of the latent image is produced, and means are provided for adjusting the charge-to-mass ratio of the toner in response to said signal.

In accordance with still another aspsect of the present invention, an electrostatographic reproduction machine includes means for producing a signal having a value characteristic of the difference between the density of a developed image and a target density. An ion generating source produces an ion cloud which is directed to the developer mixture.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present invention is described below in the environment of an electrophotographic copier. Although this invention is suitable for use with such machines, it also can be used with other types of electrostatographic copiers and printers.

As used herein, the term "toning contrast" means the ratio of the output maximum density $D_{max}$ to the absolute value of the difference between the development station electrode bias and the photoconductor voltage relative to ground just after exposure.

Figure 1:
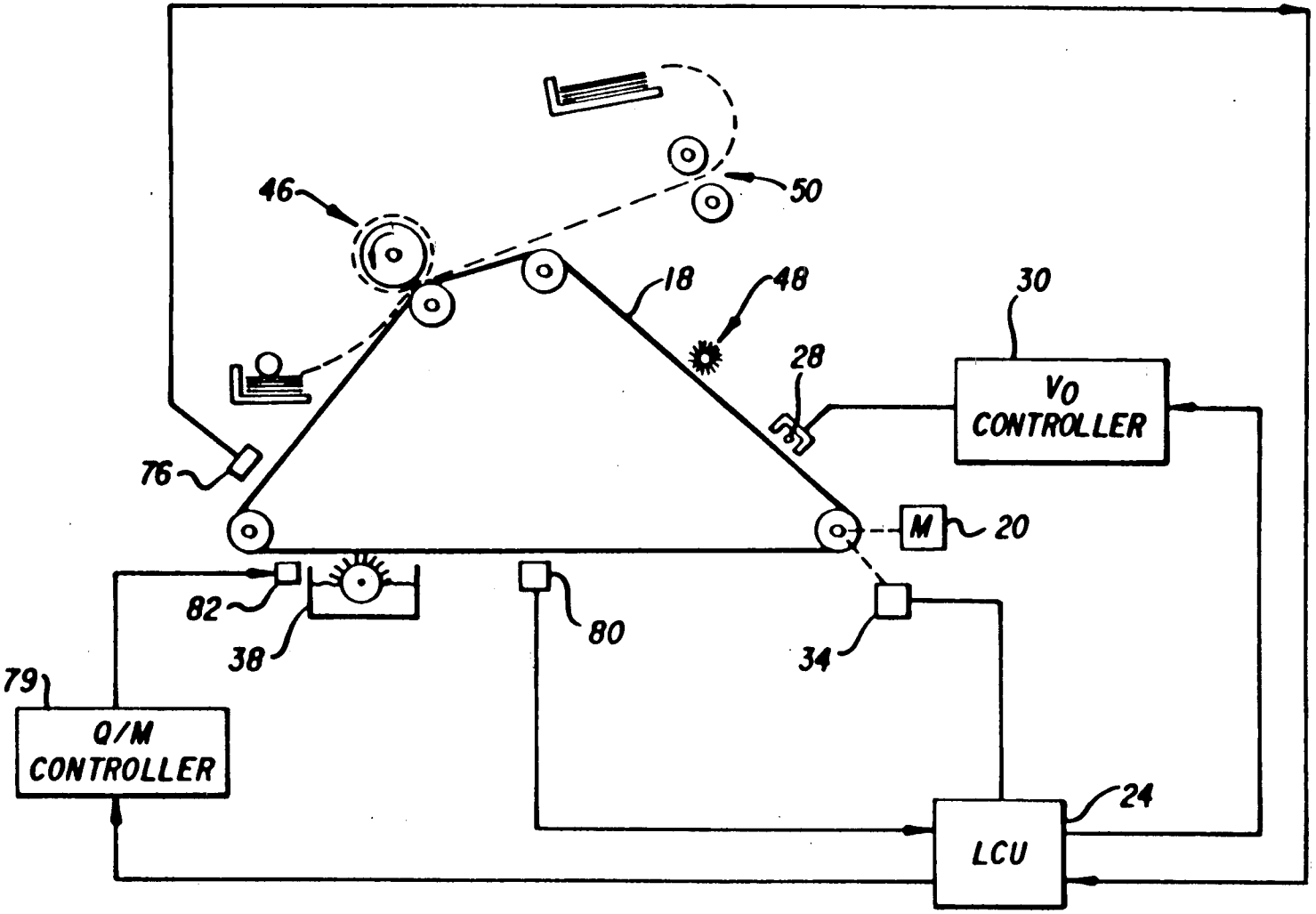
FIG. 1 is a schematic showing a side elevational view of an electrostatographic machine in accordance with a preferred embodiment of the invention.

Referring to FIG. 1, a moving transfer member such as photoconductive belt 18 is driven by a motor 20 past a series of work stations of the printer. A logic and control unit (LCU) 24, which has a digital computer, has a stored program for sequentially actuating the work stations. Programming commercially available microprocessors is a conventional skill well understood in the art. The following disclosure is written to enable a programmer having ordinary skill in the art to produce an appropriate control program for such a microprocessor. The particular details of any such program would depend on the architecture of the designated microprocessor.

For a complete description of the work stations, see commonly assigned U.S. Pat. No. 3,914,046. Briefly, a charging station 28 sensitizes belt 18 by applying a uniform electrostatic charge of predetermined primary voltage $V_0$ to the surface of the belt. The output of the charger is regulated by a programmable controller 30, which is in turn controlled by LCU 24 to adjust primary voltage $V_0$.

At an exposure station 34, projected light from a write head dissipates the electrostatic charge on the photoconductive belt to form a latent image of a document to be copied or printed. The write head preferably has an array of light-emitting diodes (LED's) or other light source for exposing the photoconductive belt picture element (pixel) by picture element. Alternatively, exposure may be by means of laser exposure, optical projection of light reflected from, or transmitted through, an original document, etc.

Travel of belt 18 brings the areas bearing the latent images to a development station 38. The development station has one (more if color) magnetic brush in juxtaposition to, but spaced from, the travel path of the belt. Magnetic brush development stations are well known. For example, see U.S. Pat. Nos. 4,473,029 to Fritz et al. and 4,546,060 to Miskinis et al.

LCU 24 selectively activates the development station in relation to the passage of the image areas containing latent images to selectively bring the magnetic brush into operation. The charged toner particles of the magnetic brush are attracted to the oppositely imagewise charge pattern of the latent image to develop the pattern.

A transfer station 46 and a cleaning station 48 are both fully described in commonly assigned U.S. patent application Ser. No. 809,546, filed Dec. 16, 1985, now abandoned. After transfer of the unfixed toner images to a receiver sheet, such sheet is transported to a fuser station 50 where the image is fixed.

Figure 2:
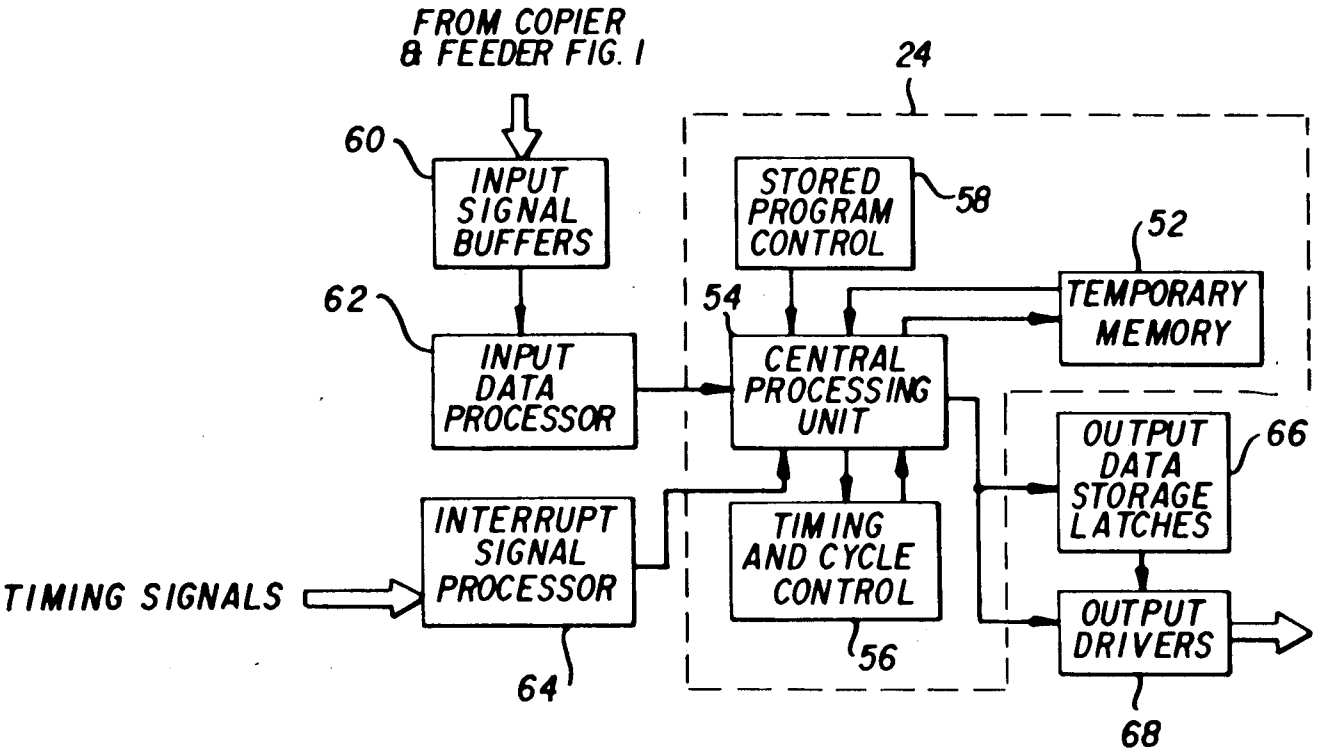
FIG. 2 is a block diagram of the logic and control unit shown in FIG. 1.

Referring to FIG. 2, a block diagram of a typical LCU 24 is shown. The LCU consists of temporary data storage memory 52, central processing unit 54, timing and cycle control unit 56, and stored program control 58. Data input and output is performed sequentially under program control. Input data are applied either through input signal buffers 60 to an input data processor 62 or through an interrupt signal processor 64. The input signals are derived from various switches, sensors, and analog-to-digital converters.

The output data and control signals are applied directly or through storage latches 66 to suitable output drivers 68. The output drivers are connected to appropriate subsystems.

Process control strategies generally utilize various sensors to provide real-time control of the electrostatographic process and to provide "constant" image quality output from the user's perspective. For example, the primary voltage $V_0$ on film 18 is measured by an electrometer 80, and is compared to a reference signal value "target $V_0$" representing a desired primary voltage. The comparison produces a signal for adjusting $V_0$ controller 30 to obtain the proper primary voltage for the next frame.

Figure 3:
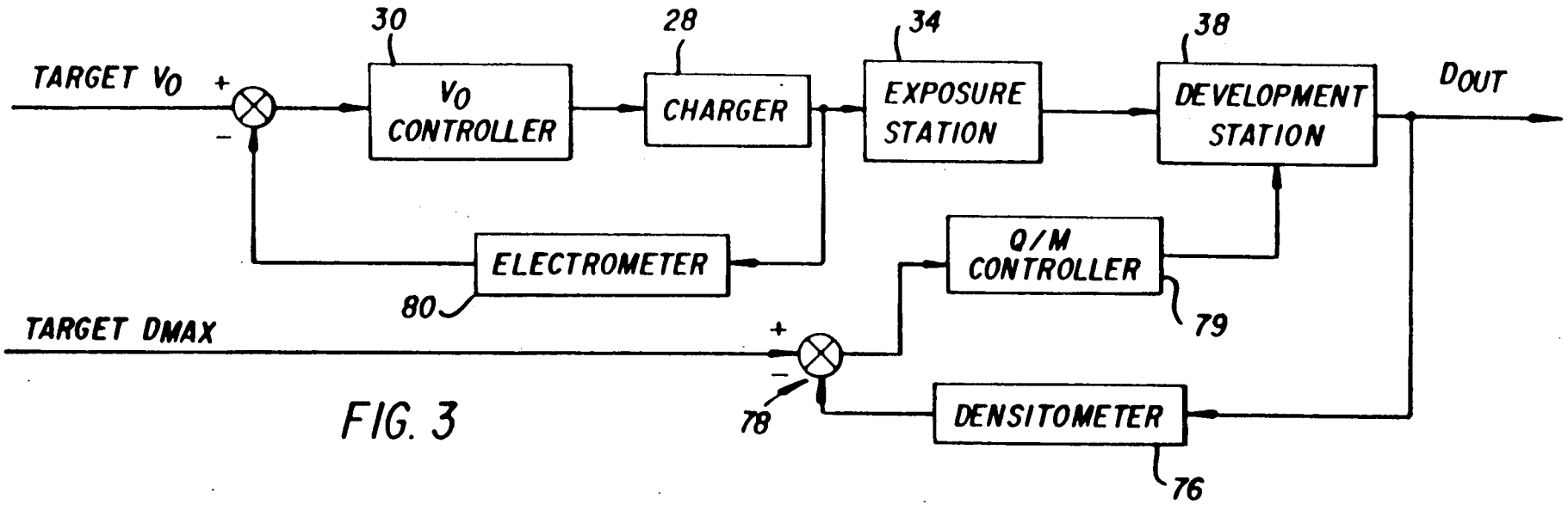
FIG. 3 is a diagram of the process for deriving a charge-to-mass parameter control signal for the electrostatographic machine of FIG. 1.

Another such sensor may be a densitometer 76 (FIGS. 1 and 3) to monitor development of test patches in non-image areas of photoconductive belt 18, as is well known in the art. The densitometer may consist of an infrared LED which shines through the belt or is reflected by the belt onto a photodiode. The photodiode generates a voltage proportional to the amount of light received. This voltage is compared to the voltage generated due to transmittance or reflectance of a bare patch, to give a signal representative of an estimate of toning contrast.

The output of densitometer 76, upon being suitably amplified, is compared at 78 to a reference signal value "Target $D_{max}$" representing a desired maximum density output level. The output of comparator 78 may be fed to a controller 79 which produces an output signal for adjusting the toner charge-to-mass ratio by selectively activating an ion generating source 82.

Figure 4:
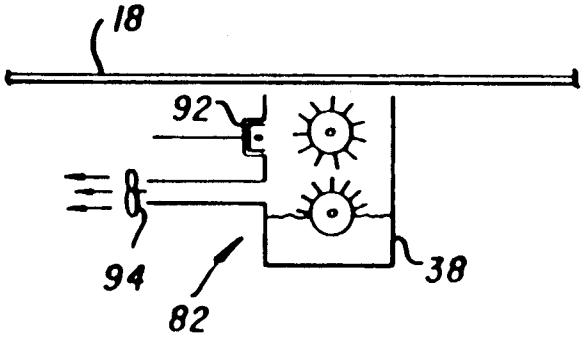
FIG. 4 is a schematic showing apparatus for applying ionized air to control toner charge.

FIG. 4 schematically illustrates the preferred apparatus for controlling the toner particle charge. An ion generator 82 may take several forms. In the illustrated embodiment, a corona generator 92 produces an ion cloud which is directed to the developer mixture by a blower 94, transferring the ion charge to the toner particles. Corona wire 92 or other ion generator is preferably bi-polar so that either positive or negative ions can be generated to raise or lower the charge-to-mass ratio of positive toner, or to lower or raise the charge-to-mass ratio of negative toner, respectively.

During experimentation, it has been found that the ions can be migrated over considerable distances by the air stream generated by blower 94. Longer distances gives the ions opportunity to recombine and loose efficiency, but eleven inches between the ion source and the development station have not proven to be excessive during the experiments.

The invention has been described in detail with particular reference to preferred embodiments thereof, but it will be understood that variations and modifications can be effected within the spirit and scope of the invention.

What is claimed is:

1. In an electrostatographic reproduction machine having means for developing an electrostatic latent image with charged toner particles, the improvement comprising:

means for producing a signal having a value characteristic of the toned density of the developed image; and means responsive to said signal for adjusting the charge-to-mass ratio of the toner, wherein said adjusting means includes (1) a source of ions and (2) means for directing the ions to the toner particles.

2. The improvement defined in claim 1 wherein said signal producing means comprises means for comparing the toned density of the developed image to a reference value.

3. The improvement defined in claim 1 wherein said source of ions is capable of producing positive and negative ions.

4. The improvement defined in claim 1 wherein said source of ions is a corona charger.

5. In an electrostatographic reproduction machine having means for developing an electrostatic latent image with charged toner particles, the developing means includes a development station with a bias electrode; the improvement comprising:

means for producing a toning contrast signal having a value characteristic of the ratio of the density of a developed image to the absolute value of the difference between the development station electrode bias and the charge of the latent image; and means responsive to said signal for adjusting the charge-to-mass ratio of the toner, wherein said adjusting means includes (1) a source of ions and (2) means for directing the ions to the toner particles.

6. The improvement defined in claim 5 wherein said signal producing means comprises means for comparing the toned density of the developed image to a reference value.

7. The improvement defined in claim 5 wherein said source of ions is capable of producing positive and negative ions.

8. The improvement defined in claim 5 wherein said source of ions is a corona charger.

9. An electrostatographic reproduction machine having means for developing an electrostatic latent image with charged toner particles; the machine comprising:

means for producing a signal having a value characteristic of the difference between the density of a developed image and a target density;

an ion generating source for producing an ion cloud;

means for directing the ion cloud to the toner particles;

means responsive to said signal for selectively activating the ion generating source for adjusting the charge-to-mass ratio of the toner of the developed image.

10. The improvement defined in claim 9 wherein said signal producing means comprises means for comparing the toned density of a developed image to a reference value.

11. The improvement defined in claim 9 wherein said source of ions is capable of producing positive and negative ions.

12. The improvement defined in claim 9 wherein said source of ions is a corona charger.

* * * * *